US006450262B1

(12) United States Patent
Regan

(10) Patent No.: US 6,450,262 B1
(45) Date of Patent: Sep. 17, 2002

(54) RISER ISOLATION TOOL

(75) Inventor: Albert M. Regan, Cypress, TX (US)

(73) Assignee: Stewart & Stevenson Services, Inc., Houston, TX (US)

( * ) Notice: Subject to any disclaimer, the term of this patent is extended or adjusted under 35 U.S.C. 154(b) by 0 days.

(21) Appl. No.: 09/733,128

(22) Filed: Dec. 8, 2000

Related U.S. Application Data

(60) Provisional application No. 60/169,878, filed on Dec. 9, 1999.

(51) Int. Cl.[7] ..... E21B 7/12

(52) U.S. Cl. ..... 166/350; 166/368; 175/214

(58) Field of Search ..... 166/350, 359, 166/368, 357, 267; 175/7, 10, 214, 218

(56) References Cited

U.S. PATENT DOCUMENTS 4,632,188 A * 12/1986 Schuh et al. ..... 166/368
5,085,277 A * 2/1992 Hopper ..... 166/341
6,230,824 B1 * 5/2001 Peterman et al. ..... 175/214
6,325,159 B1 * 12/2001 Peterman et al. ..... 175/7

* cited by examiner

*Primary Examiner*—Frank S. Tsay
(74) *Attorney, Agent, or Firm*—Browning Bushman

(57) ABSTRACT

Two types of isolation tools are disclosed for installation between the upward end of the LMRP and the lower end of a riser string in the drilling of a subsea well using dual gradient techniques, one of which is especially adapted for rotation about a rotating drill sling. Each type includes insert packer adapted to be closed about the drill string to divert drilling fluid in the annulus between the drill string and the subsea wellhead into lines extending along the side of the riser to the surface. The insert is selectively removable to permit conventional drilling.

10 Claims, 9 Drawing Sheets

RISER ISOLATION TOOL

This application claims the benefit of the filing date of my Provisional Application No. 60/169,878, filed Dec. 9, 1999, and assigned to the assignee of the present application.

My invention relates generally to a marine riser system for use in the drilling of subsea wells from a floating platform on a drilling vessel. More particularly, it relates to improvements in such systems employing dual gradient drilling techniques.

In the conventional drilling of a subsea well, a wellhead at the ocean floor connects to the platform at the surface by a riser system which includes, from bottom to top, a blowout preventer stack on the subsea wellhead, a lower marine riser package, a riser string made up of the individual riser joints, a telescopic joint and a diverter at the vessel. The purpose of the riser system is to control the well at the ocean floor, to guide the drill string and other tools into and out of the well, and to return the drilling mud and cuttings back to the drilling vessel for processing.

The weight of the riser string is often supported by a combination of buoyancy modules carried by the individual riser joints and tensioning equipment attaching the upper end of the riser string to the drilling vessel. The need for support includes the weight of the drilling mud column which is circulated through the drill string, out the bit, and up the annulus between the drill string and the riser back to the drilling vessel.

The drilling mud cools, lubricates and cleans the drill bit and carries the drilled cuttings to the surface, and the mud's hydrostatic weight controls the well bore pressure. The mud is an engineered fluid, so that if the hydrostatic pressure is too high, the drilling mud may be lost and damage the formation. If the hydrostatic pressure is too low, formation fluids and gasses may flow into the well, where they must be controlled by the blowout preventer equipment.

In deep subsea wells, it is difficult to control the hydrostatic head of the drilling mud, and small changes in the density of the drilling fluid can cause large differences in down hole pressure. In one procedure proposed to address this problem, known as riserless drilling, the drilling mud is returned to the drilling vessel by being either pumped and/or gas lifted from the subsea BOP to the surface. This is an attempt to remove the effects of the hydrostatic head from the top of the subsea wellhead, and usually accomplished by having a second mud return riser in addition to the annulus within the drilling riser through which the drill string extends. Since most drilling vessels can only handle one riser at a time, this is a time consuming and difficult task.

Another procedure is known as underbalanced or dual gradient drilling in which nitrogen gas is added to the drilling fluid at the subsea level. The density of the aired up mud can then be controlled in an attempt to give the desired hydrostatic head at the subsea wellhead. In this system, the mud also returns to the drilling vessel through the annulus between the drill string and the riser, and a rotating blowout preventer is required at the surface to contain the gas in the annulus. In true underbalanced or dual gradient drilling, the pressure is normally less than the formation pressure. Under these conditions, the rate of drill penetration into the formation is greatly increased.

A co-pending patent application, Ser. No. 09/618,883, filed Jul. 18, 2000, entitled "System and Method for Drilling Deep Water Subsea Wells", and assigned the assignee of this application, discloses a procedure for handling the returning drilling mud without the shortcomings of the above described procedures. More particularly, it not only avoids the need for a second riser, as well as the obvious risks of collapse of the riser pipe attendant to underbalanced drilling, but also reduces the flow area available to the returning mud to thereby increase the velocity of the mud and thus aid in removing the cuttings from the well bore. The smaller column of mud reduces the tensioning requirements of the rig as well as the quantity of drilling mud to be carried on the rig. The system is also environmentally more friendly than conventional drilling, and, in the case of an unintentional drive off of the drill ship, reduces the amount of mud that would be lost to the ocean floor.

More particularly, the system is shown and described in the co-pending application as enabling the returning drilling fluid to be selectively diverted into a mud return line entering upwardly to the surface along the side of the riser string. Thus, in accordance with my invention, this diversion is accomplished by a system which includes an "isolation" tool installed between the LMRP and the lower end of the riser string so that, during dual gradient drilling, the heavy drilling mud may be isolated from the riser annulus, but which is of such construction as to enable the well bore to be easily, alternatively, and quickly entered.

Thus, in accordance with its illustrated and preferred embodiments, the isolation tool comprises a housing adapted to be connected as a lower continuation of the riser and having a bore through which the drill string may extend during the drilling of the well, an annular recess about the bore, and a side port below the recess for connecting the bore to a mud return line extending alongside of the riser and leading to the surface, as in the aforementioned application. An insert packer including a sleeve of elastomeric material is adapted to be lowered into and raised from a landed position in the bore opposite an actuator within the housing recess having a sleeve of elastomeric material which, when retracted, occupies a position in which the insert packer may be removed, forming a continuation of the bore so as to receive a drill string therethrough. When the insert packer is in place, the actuator sleeve is responsive to the supply of control fluid thereto from an outside source to engage and contract the sleeve of the insert packer about the drill string, so that the drilling fluid flowing upwardly in the annulus between the riser and drill string is directed into the side port in the housing bore. In response to the exhaust of the control fluid, the insert packer sleeve is free to expand to fully open the bore and the insert to be removed.

In one form, the actuator sleeve has metal rings at both ends to seal with the housing recess in order to contain the control fluid. The insert packer sleeve also includes upper and lower metal rings, and a pin is mounted on the housing for extension inwardly of the bore to support the lower ring of the insert packer opposite the actuator sleeve. More particularly, one of the rings has an outer recess and another pin is mounted in the housing for extension inwardly of the bore to engage in the recess to hold the packer insert down in the landed position.

In another embodiment of the invention adapted for use when the drilling string is rotating, the insert packer includes a carrier body having a recess about its inner side, and an elastomeric sleeve having a bearing ring at each end slidably rotatable within the body recess for rotation with the drill string when closed thereabout. More particularly, the actuator includes three vertically spaced elastomeric sleeves within the recess of the housing body and separated by spacer rings in position to be contracted by control fluid supplied from an outside source to close about the outside of the carrier body, and thus form upper and lower fluid pressure chambers.

Each of the spacer rings has a port therethrough leading to its adjacent pressure chamber, and the carrier body and bearing rings have passageways connecting at opposite ends to the upper and lower pressure chambers on the outer side of the sleeve within the recess of the carrier body, whereby control fluid may be supplied from an outside source into one port and out the other. Thus, when the actuator sleeves are contracted about the carrier body, control fluid will circulate through the passageways in order to contract the actuator sleeve about the insert packer sleeve and thus contract it about the drill pipe. Due to its rotating support within the carrier body, the sleeve of the insert packer is free to rotate with the pipe. The relief of such control fluid permits the sleeve of the actuator, and thus the sleeve of the insert packer, to expand to permit the insert packer to be retrieved.

Preferably, the carrier body has a main portion in which one end of the recess is formed, and a retainer portion removably connected to the main portion and on which the other end of the recess is formed, whereby the sleeve and bearing rings of the insert packer may be installed or removed upon removal of the retainer portion. More particularly, a pin is mounted on the housing for movement inwardly of the bore to support the carrier body, and there is a recess in the outer side of the body into which another pin mounted on the housing body is adapted to be moved to hold the packer insert in landed position and out of the recess to free the carrier body and insert packer sleeve for removal from the housing bore.

With reference now to the drawings, wherein like reference characters are used throughout to designate the like parts:

Figure 1:
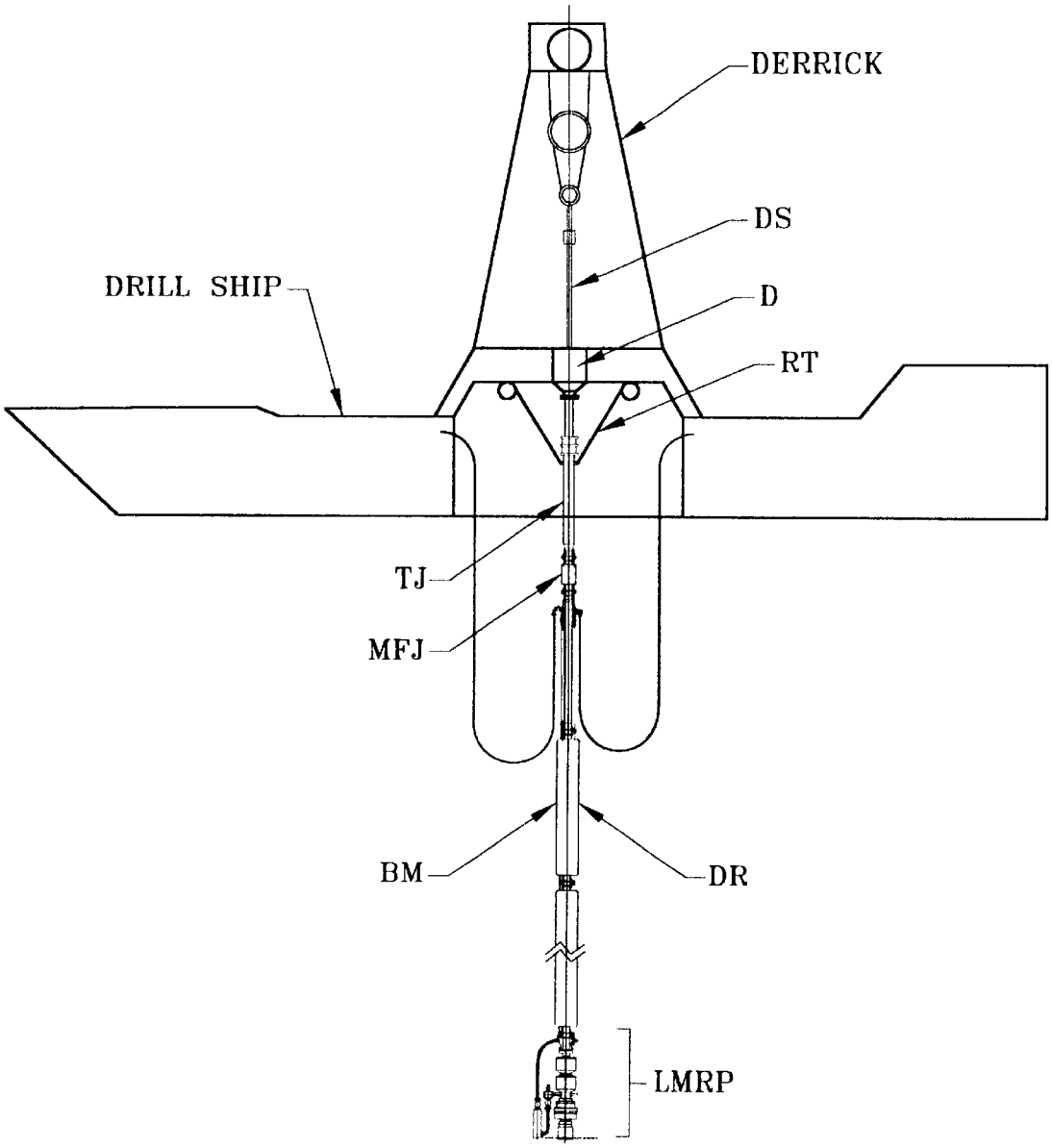
FIG. 1 is a side view of the drilling system extending between a drill ship and the subsea wellhead at the ocean floor.

With reference to the details of the above described drawings, the drilling riser system is shown diagrammatically in FIG. 1 to include, from top to bottom, a diverter system D aboard the drill ship, a riser tensioner RT, a telescopic joint TJ, a middle flex joint MFJ, and a drilling riser DR made up of individual riser joints through which a drill string DS extends into the well through a blowout preventer on the ocean floor. The lower end of the riser is connected by a lower marine riser package LMRP to the upper end of the subsea wellhead by a blowout preventer BOP stack. As shown, buoyancy modules BM are mounted on at least certain of the riser joints so as to support the drilling riser, along with riser tensioner on the vessel.

Figure 2:
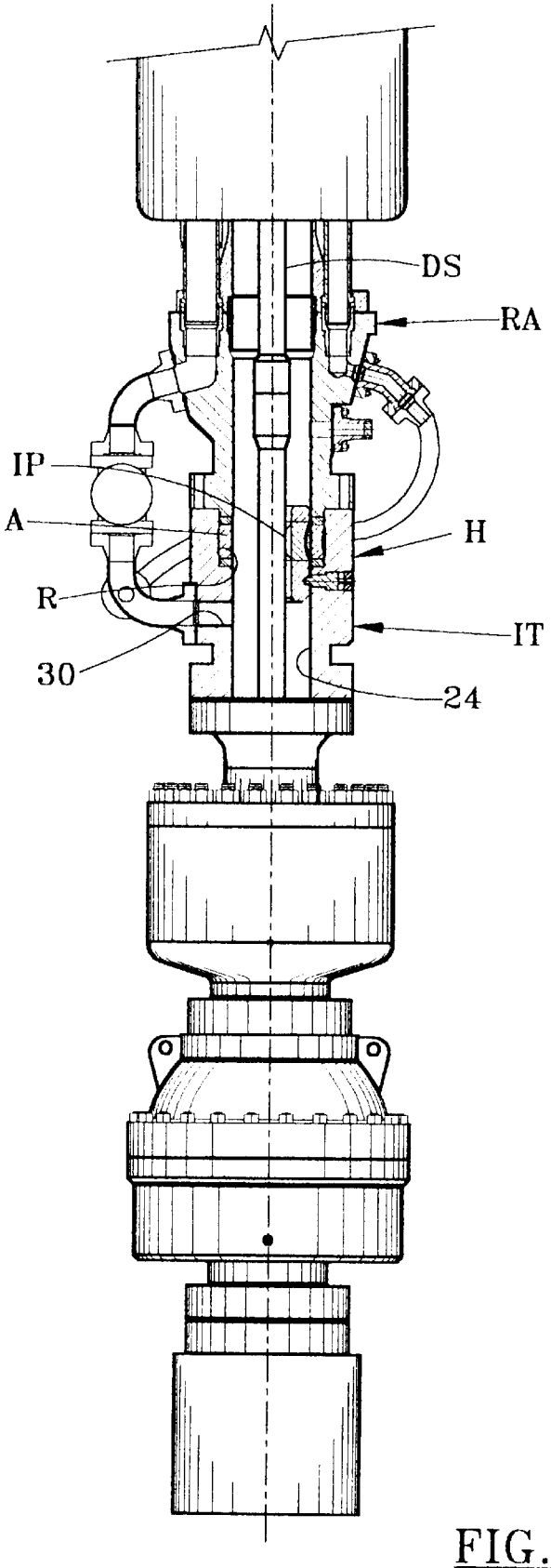
FIG. 2 is a vertical sectional view of the first mentioned embodiment of the riser isolation tool on the upper end of the lower marine riser package, with the insert packer sleeve closed about a drill string on the right side to divert drill fluid into a side outlet and removed from the left side to permit conventional drilling.

As shown in FIG. 2, for example, the isolation tool IT installed on the LMRP includes a tubular housing H having a bore 24 connecting to the lower end of the drilling riser with the bore of the LMRP below it. An insert packer IP is adapted to be installed within the bore of the housing in position to be contracted into sealing engagement about the drill string DS extending therethrough, as shown on the right side of FIG. 2. The insert packer is shown removed from the well bore of the housing on the left side of FIG. 2, whereby the bore is fully open for normal drilling operations.

Figure 3:
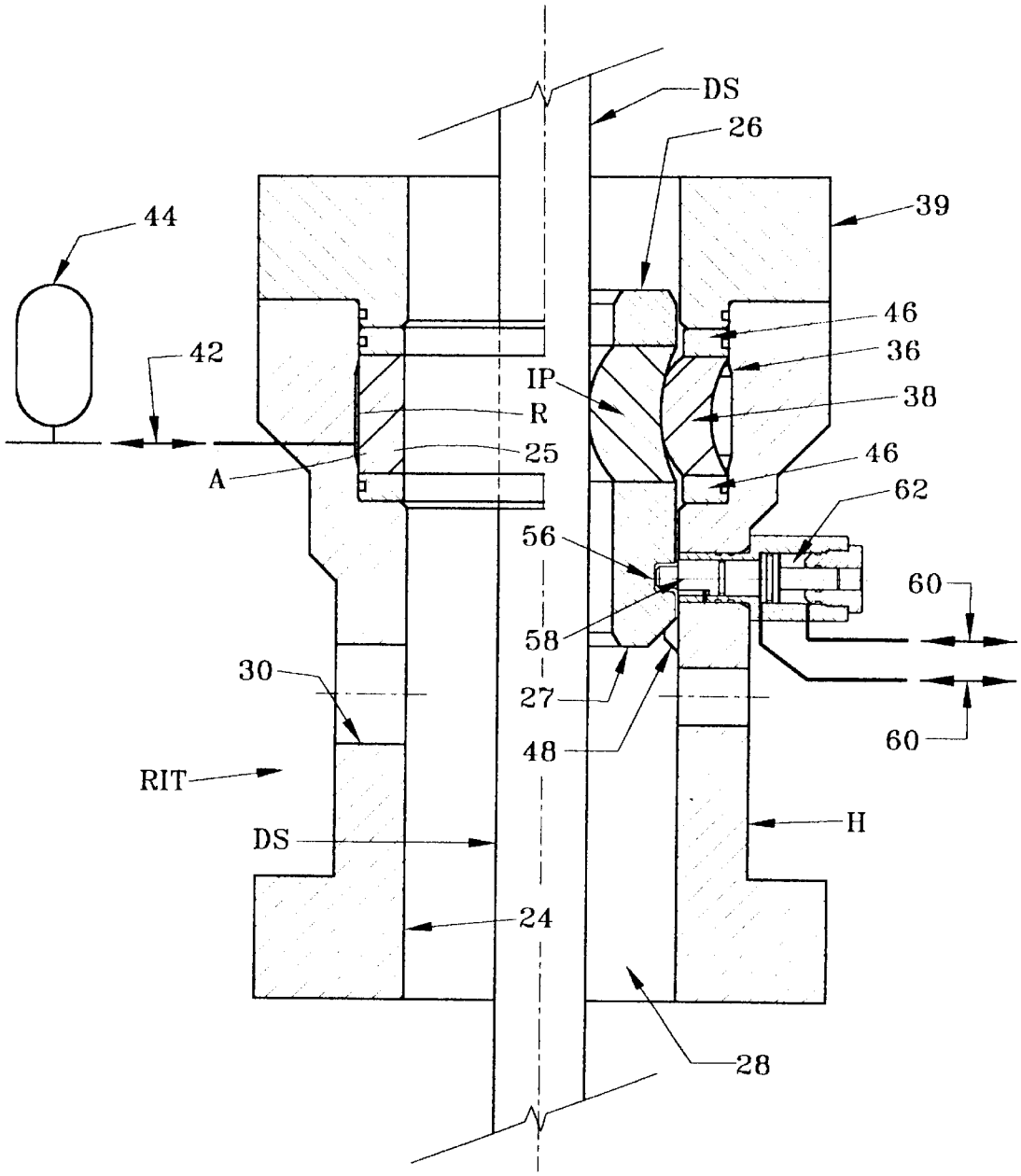
FIG. 3 is an enlarged sectional view of the isolation tool of FIG. 2 including arrows illustrating fluid paths of the control fluid for operation of the insert packer sleeve as well as the pin for selectively holding the insert packer down in landed position.

The insert packer IP comprises an elastomeric sleeve 25 having metal rings 26 and 27 on the upper and lower ends which forms a smooth continuation of the housing bore in the expanded portion. As best shown in FIG. 3, the insert packer IP is moved between contracted and expanded positions by an actuator comprising an elastomeric sleeve 36 having metal rings 46 at its opposite end and received within the recess R in the bore of the housing to surround the insert packer IP installed in the housing bore. The upper end of the housing recess R is closed by a flange 39 at its upper end which may be removed to permit the actuator to be installed or replaced for repair. As above mentioned, a side port 30 formed in a main body portion beneath the recess connects with a mud return line so that, as will be described, when the insert packer is closed, drilling mud may be diverted into it.

With the insert removed, the inner diameter of the expanded actuator sleeve 36 opens the annulus about a drill string to form a smooth continuation of the housing bore 24. In either mode, the housing of the IT also supports the bending and tension load requirements of the riser system. The removable insert packer is run in or retrieved from the housing by a running tool RT (See FIG. 8) that is added to the drill pipe string DS, as described to follow.

As shown in FIG. 3, a set of hydraulically operated pins 48 or bolts is carried by the housing so that, when moved inwardly, they provide a landing shoulder in the housing bore to position the insert packer opposite the actuator. A second set of hydraulically operated pins 58 carried by the housing fit one adapted to be moved into an annular groove 56 about the insert packer to lock it in place to prevent its up or down movement in the bore. An upward pull on the drill string can confirm the lock down. The hold down pins are, of course, retracted as the insert is lowered onto or raised from the support pins. When the support pins are withdrawn, shear pins SP (FIG. 8) between the running tool and insert packer may be sheared allowing the drill string to continue to the bottom of the hole and commence drilling.

The annulus 28 between the housing bore and the insert packer may be sealed off by contraction of the actuator sleeve 36 by means of fluid pressure from accumulator 44 supplied to the recess about the sleeve through port 42 to close about the drill string to seal off well fluid in the annulus above and below it. The pressure is such as to allow the pipe and its tool joints to pass through it while maintaining a seal (stripping) in either direction. The actuator 36 also includes metal rings 46 at both ends of sleeve 36, each carrying a seal ring thereabout to seal off the recess to contain actuating fluid in the recess.

Figure 4:
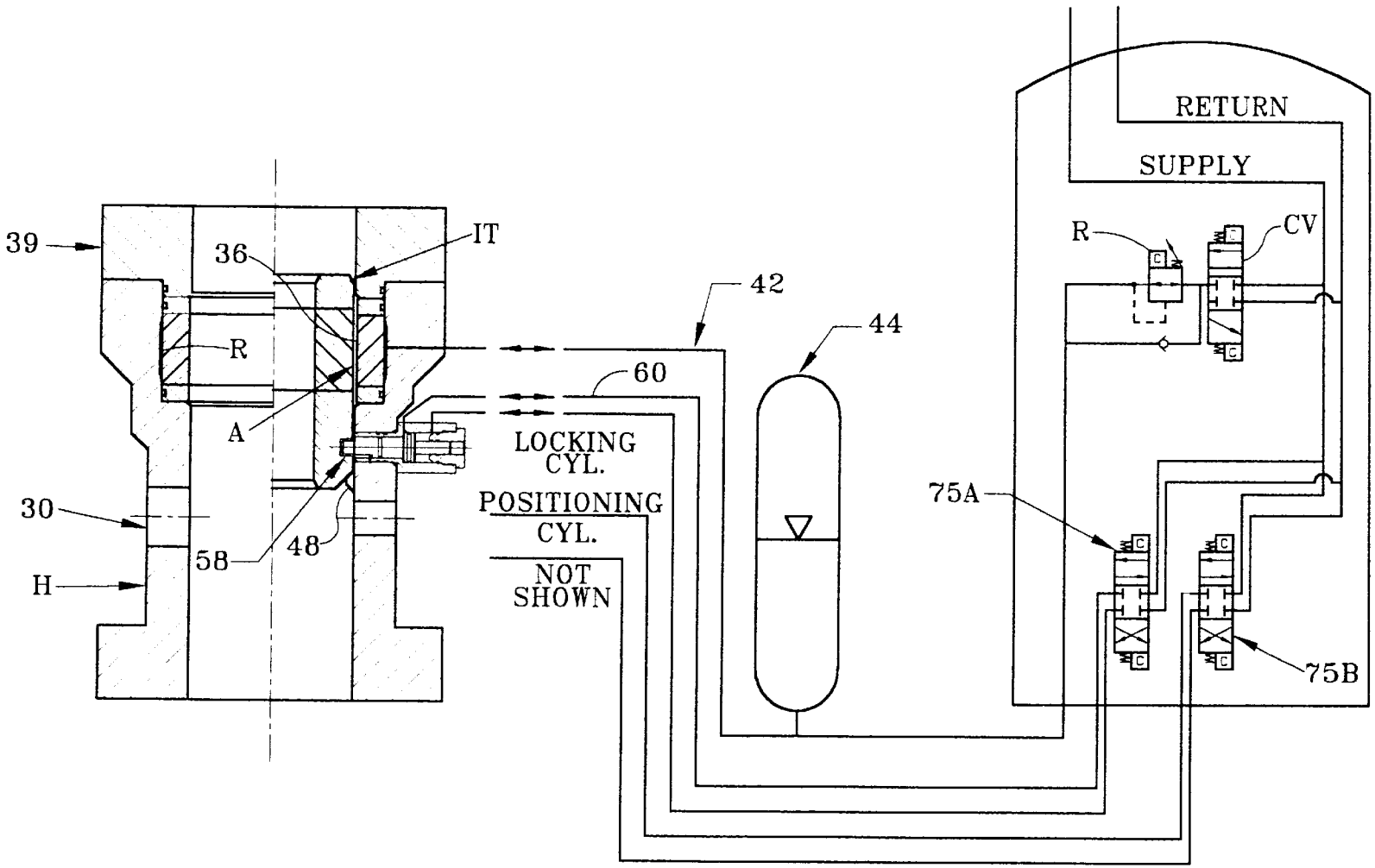
FIG. 4 is another view of the isolation tool of FIGS. 2 and 3 with a diagrammatic illustration of the control systems within a pod of a blowout preventer control system for operating both the insert packer and support and hold down pins.

FIG. 4 shows the tool IT of FIGS. 1 to 3 with a typical hydraulic control system mounted in a subsea control pods the supply end exhaust of control fluid. The system includes control valve CV, a remotely settable pressure regulator R, and an accumulator 44 located near or on the IT to control flow to and from the actuator in the recess in the body bore as well as to and from operator for pins 48 and 58. The pressure applied through line 42 to the outer diameter of the actuator sleeve 36 displaces it inwardly to close the actuator sleeve on the sleeve of the insert packing. Additional pressure applied to the actuator sleeve displaces the insert packer sleeve inwardly causing it to seal on the drill pipe. The accumulator allows the insert packer to open up easily to allow tool joints to be stripped though it. As also shown in schematically in FIG. 4, valves 75A and 75B control the supply and return of control fluid to and from operators for pins 48 and 58.

Figure 5:
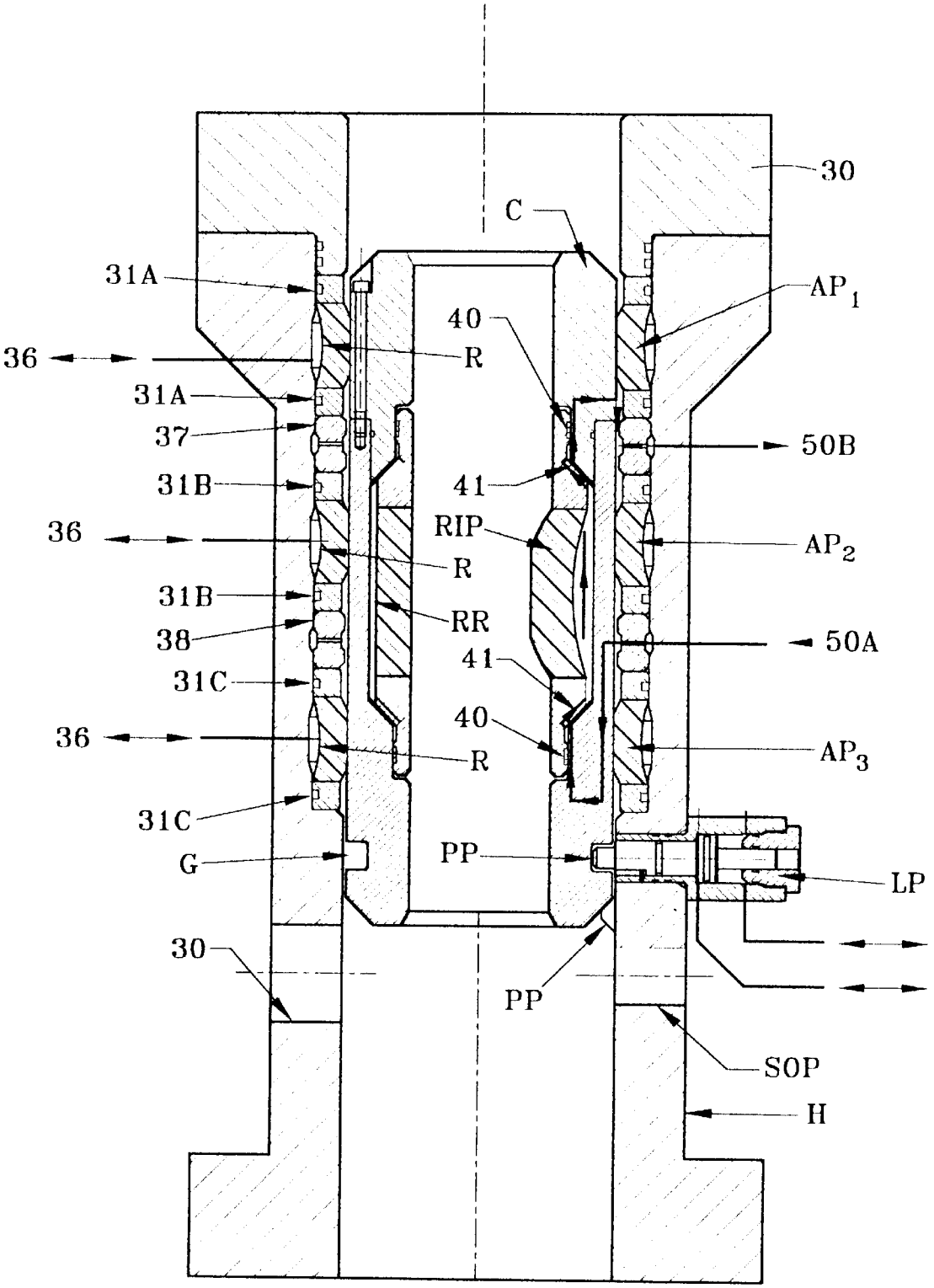
FIG. 5 is a sectional view of the rotating embodiment of the isolation tool and including arrows illustrating fluid paths of the operating fluid system therefor.
Figure 6:
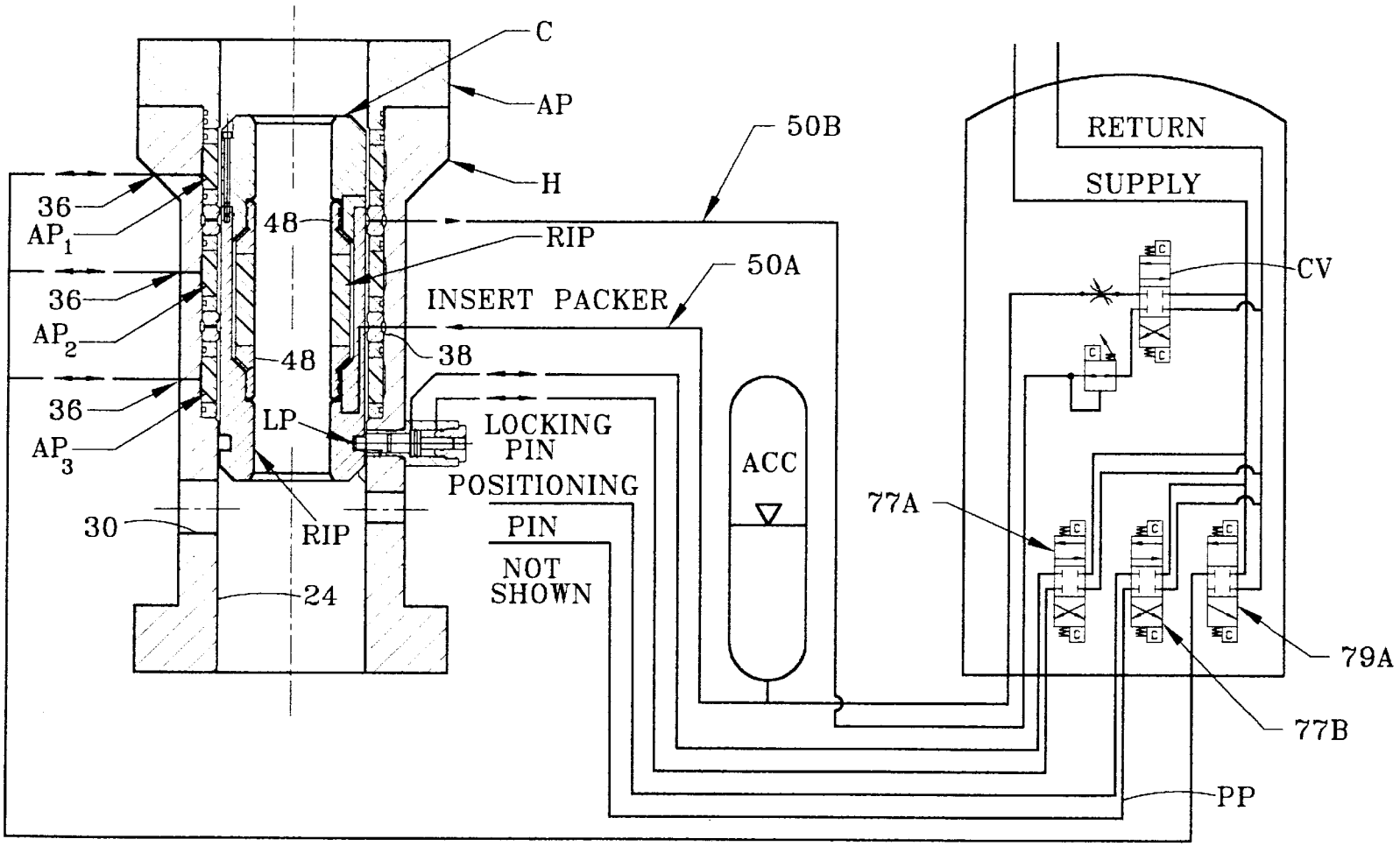
FIG. 6 is a another sectional view of the tool of FIG. 5 and also showing the control systems disposed within a blowout preventer pod.
Figure 7A:
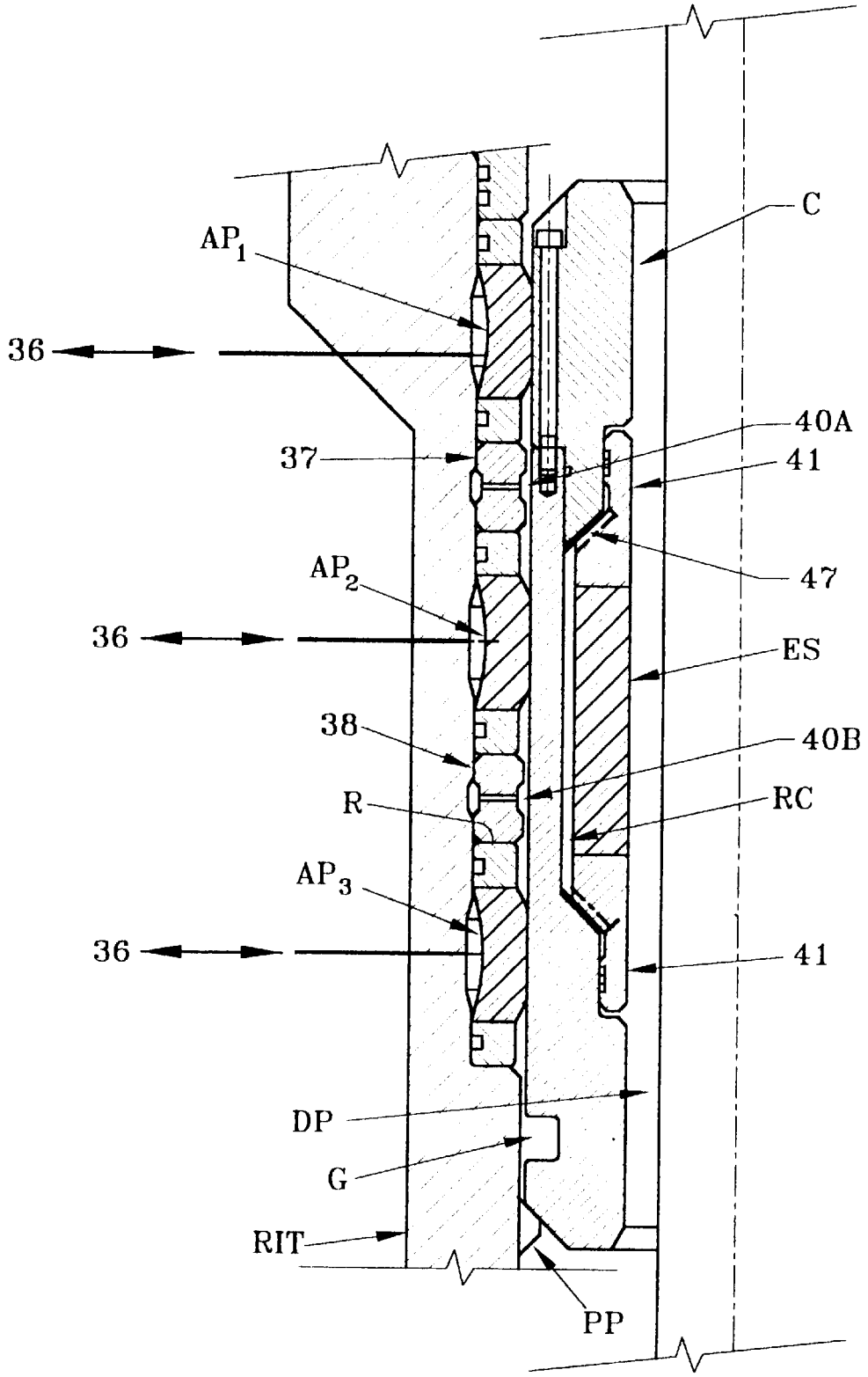
FIGS. 7A and 7B are enlarged sectional views of the left and right sides respectively of the tool of FIGS. 5 and 6 and showing, respectively, positions of its insert packer and actuator during successive stages of operation.
Figure 7B:
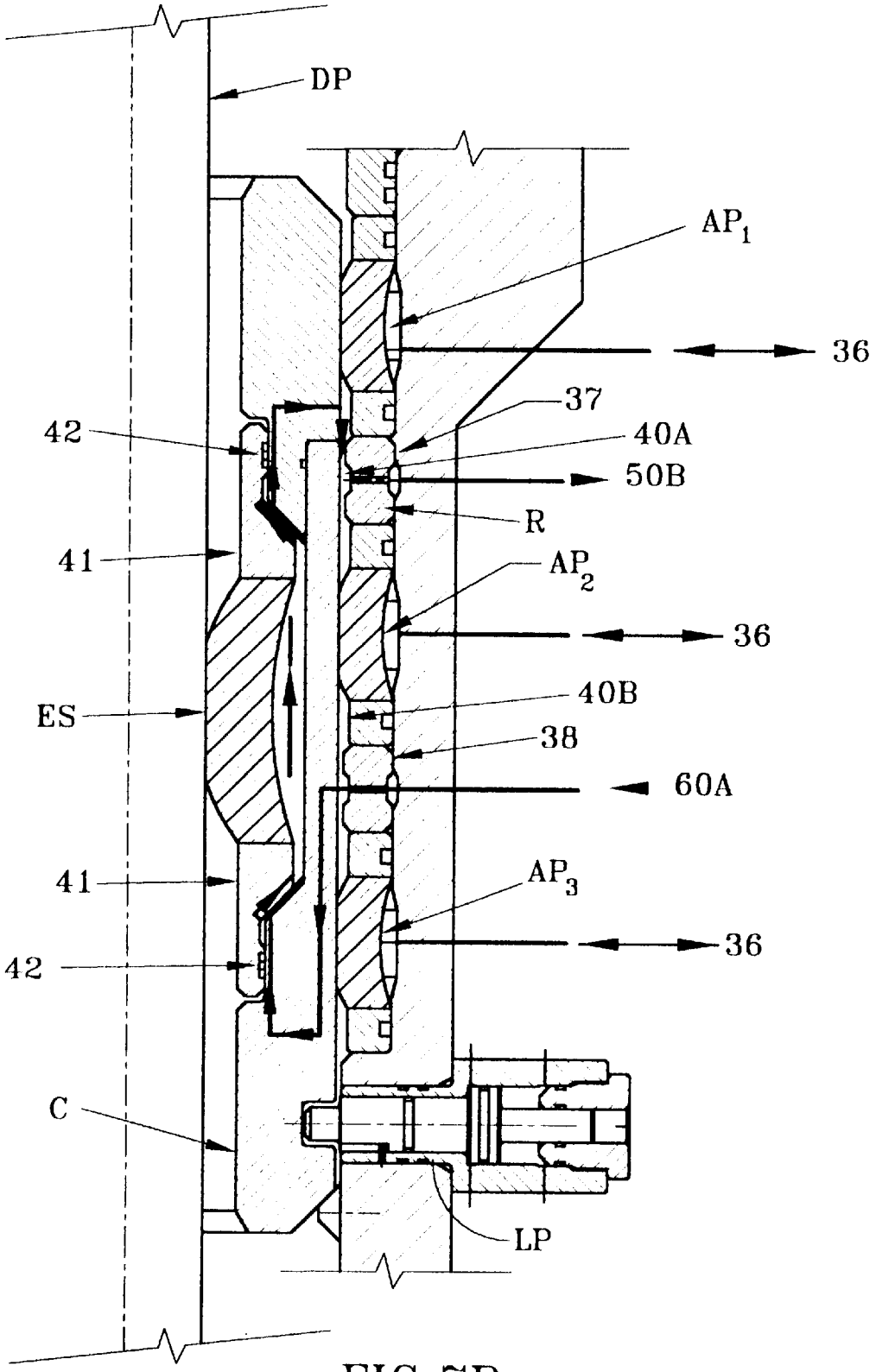

FIGS. 5 and 6 show the rotating form RIT of the isolation tool which accommodates pipe rotation, and includes an actuator having three annular elastomeric sleeves $AP_1$, $AP_2$, and $AP_3$ mounted in the recess R of its housing bore in position to be hydraulically energized to engage and seal against a rotating insert packer. As shown in FIGS. 7A and 7B, these sleeves, when so energized, isolate two annular bands between the actuator which connect with an outside service of control fluid through lines for the operation of the insert packer.

More particularly, the three annular sleeves $AP_1$, $AP_2$, and $AP_3$ are separated by metal spacer rings 37 and 38 between them are removably retained in recess R of housing by an upper adapter flange AP. Rings 31A are disposed above and below packer $AP_1$, rings 31B above and below packer $AP_2$, and rings 31C above and below annular packer AP carry seal rings which engage the recess to isolate the bands from one another.

The rotating insert packer RIP lands on the inner ends of the positioning pins PP when extended, and lock down pins LP are, when extended, received in groove G about a carrier body C of the packer insert to hold it opposite the actuator. The carrier body has a recess R to receive an elastomeric sleeve ES having metal bearing rings 41 and 42 at its ends and rotatable with drill pipe within the carrier within the carrier body recess. As shown in FIG. 6, control valve 79A within the control pod enables hydraulic pressure to be supplied to or exhausted from ports 36 to control the movement of sleeve segments $AP_1$, $AP_2$, and $AP_3$ toward or from the carrier body C of the insert packer. When the sleeves are moved inwardly, they form the two annular bands about the carrier body, so that control fluid is confined to pass completely around the insert position. The rotating insert packer sleeve has bearings 41 at each end of the body for rotation within tapered shoulders at both ends on the carrier recess. Seal rings 40 seal between the metal rings of the RIP at both ends above and below the bearings in passageways shown to connect with the outer side of the insert packer between them.

With spacer rings 37 and 38 are disposed between metal rings at opposite ends of adjacent sleeve segments, control fluid is supplied through ports 36 to the bands about the outside of the rotating actuator sleeve segments. Fluid from another source is then introduced through ports in ring 37 into annular bands between sleeves $AP_1$ and $AP_2$ through passageways in the carrier body and between it and the sleeve within its recess, and then returns to the operating system through the port in the ring 38 to a passageway through the carrier body into an annulus. Control fluid thus flows through passageways between the carrier body recess and bearing rings on the ends of insert packer sleeves to circulate through lines 50A and 50B to the back of the insert packer sleeve to close it on the drill pipe, as shown in FIG. 7B, or permit it to back off from the carrier, as in FIG. 7A. Control valve CV in the control pod enables operating fluid to pass, selectively moving the insert packer sleeve between the positions of FIGS. 7A and 7B. The control pod also contains two valves 77A and 77B for controlling operators of the locking and positioning pins, in an obvious manner. The system also contains a remotely settable back pressure regulator.

Since the rotating bearing rings of the insert packer are swept around with the rotating pipe, they travel over freshly wetted and cooled surfaces. Composite bearings may be used in the passageways as well as needle bearings or tapered roller bearings. The size of the packer, within the insert, is chosen to minimize the heat generated in rotation.

To summarize briefly, hydraulic pressure applied to the $AP_1$, $AP_2$ and $AP_3$ rings displaces them against the insert packer carrier body sealing across the annulus between insert packer and actuator. Control fluid is applied to the rotating insert packer and regulated by the back pressure regulator to move the insert packer sleeve inward causing it to seal on the drill pipe. The flow of control fluid between the insert packer and carrier body is remotely regulated to meet the cooling requirements of the tool. The accumulator allows the tool joints to be stripped through.

As more fully described in the above mentioned pending application, the isolation tools enable drilling fluid from the annulus to be diverted into the mud return lines as shown in FIG. 2 to be pumped to the surface during dual gradient drilling. As also shown in FIG. 2, nitrogen or other low density media may be injected into the mud return line. Alternatively, the tool may be operated to permit conventional drilling.

Figure 8:
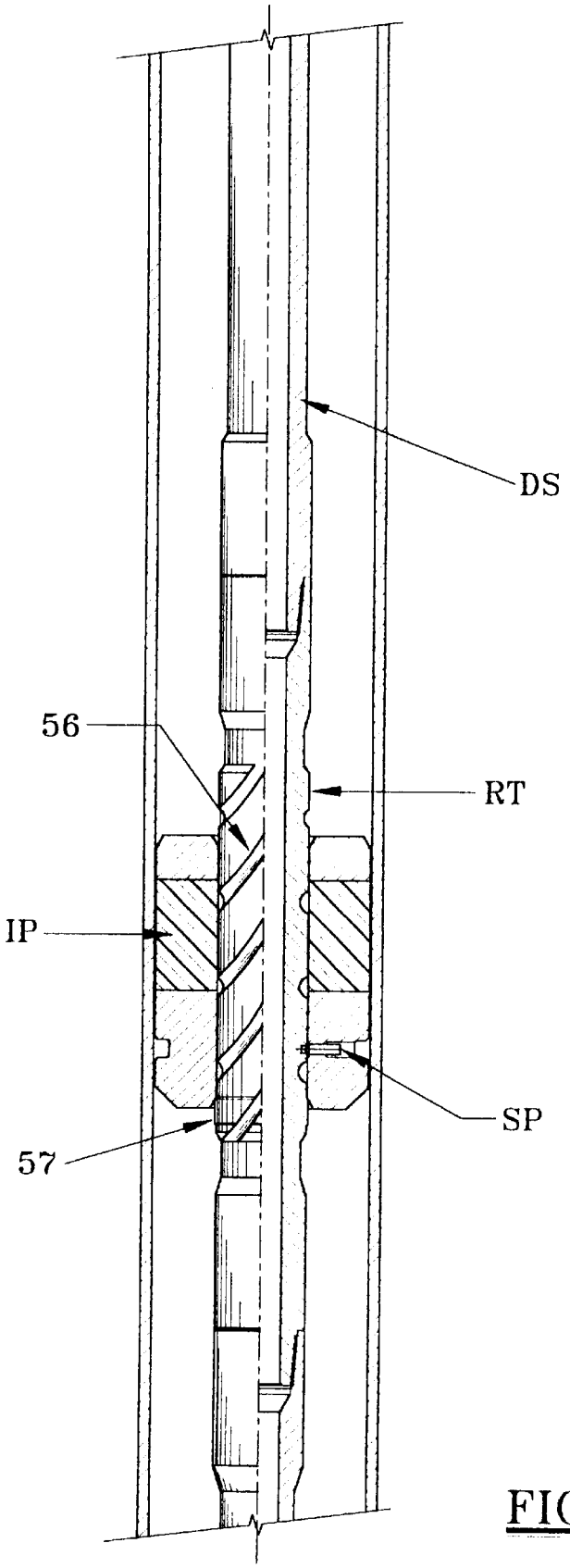
FIG. 8 is a detailed sectional view of the running tool for the insert packer, with one side in elevation and the other is section.

The running tool RT shown in FIG. 8 is added to the drill string for use in running or pulling the insert packer of either type of isolation tool. Thus, no special trips are required to run or pull them. There are spiral flutes 56 about the tool to allow well fluid to pass by the insert packer P as it is run or retrieved. The fluted design facilitates horizontal drilling, and is run and retrieved on a small external upset 57 on the tool. The insert is secured to tool by shear pins SP, which are threaded through the insert metal rings into holes located in the tool.

The insert is run in on drill pipe and landed on the inner ends of the extended positioning pins. The locking pins are engaged and an over pull taken to insure lock down. The positioning pins are then retracted and the weight of the drill string used to break the shear pins to permit lowering of the string. The insert is retrieved on the drill string by retracting the hold down pins after the running tool reaches the insert. The running tool and insert bore would be designed for the drill string being used.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An isolation tool for use in diverting the upward flow of drilling fluid within the annulus between a marine riser and a drill string extending therethrough for return to the surface outside the riser, comprising a housing adapted to be connected as part of the riser and having a bore through which the drill string may extend during the drilling of a well, an annular recess about the bore, and a side port below the recess for connecting the bore to a conduit leading to the surface;

an actuator within the recess which normally occupies a position forming a continuation of the bore; and an insert packer including a sleeve of elastomeric material adapted to be lowered into and raised from a landed position in the bore opposite the actuator so as to receive a drill string therethrough;

said actuator being responsive to the supply of control fluid thereto from an outside source to contract the sleeve about the drill string, so that drilling fluid flowing upwardly in the annulus between the riser and string is directed into the side port, and responsive to exhaust of the control fluid to return to its original position in which the actuator sleeve may expand to permit retrieval of the insert packer.

2. As in claim 1, including:

a pipe joint connectible in the drill string and received through and releasably connected to the insert packer for lowering the insert packer into landed position;

said joint having a spiral groove about its outer diameter to permit fluid flow therethrough.

3. An isolation tool for use in diverting the upward flow of drilling fluid within the annulus between a marine riser and a drill string extending therethrough for return to the surface outside the riser, comprising:

a housing adapted to be connected as part of the riser and having a bore through which the drill string may extend during the drilling of a well, an annular recess about the bore, and a side port below the recess for connecting the bore to a conduit leading to the surface;

an actuator within the recess including a sleeve of elastomeric material which normally assumes a position forming a continuation of the housing bore;

an insert packer including a sleeve of elastomeric material adapted to be lowered into and raised from a landed position in the bore between the actuator sleeve and drill string; and means for supplying control fluid from an outside source to the recess to radially contract the actuator sleeve in order to close about and contract the sleeve of the insert packer about the drill string to direct drilling fluid flowing upwardly in the annulus between the riser and string into the side port, and for venting the control fluid to permit the actuator sleeve to return to its normally expanded position and thus permit the sleeve of the insert packer to expand so that the insert packer may be retrieved.

4. As in claim 3, wherein:

the actuator sleeve also includes metal rings above and below the ends of its sleeve and carrying means to seal with the recess in order to prevent escape of the control fluid therefrom.

5. As in claim 4, wherein:

the insert packer includes metal rings above and below the ends of its sleeve, and a pin is mounted on the housing for extension inwardly of the bore to support the lower ring of the insert packer.

6. As in claim 5, including:

another pin mounted in the housing for extension inwardly of the bore to engage a ring of the insert packer to hold the packer down in the landed position.

7. As in claim 6, including:

a pipe joint connectable in the drill string and received through and releasably connected to a ring of the insert packer for lowering the insert packer into landed position, said joint having a spiral groove about its diameter to permit flow therethrough.

8. An isolation tool for use in diverting the upward flow of drilling fluid within the annulus between a marine riser and a drill string extending therethrough for return to the surface outside the riser, comprising:

a housing adapted to be connected as part of the riser and having a bore through which the drill string may extend during the drilling of a well, an annular recess about the bore, and a side port below the recess for connecting the bore to a conduit leading to the surface;

an actuator within the recess;

an insert packer adapted to be lowered into and raised from a landed position in the bore opposite the actuator so as to receive a drill string therethrough, and said insert packer including a carrier body having a recess about its inner side, and an elastomeric sleeve having a bearing ring at each end slidably rotatable within the recess for rotation therein, when closed about the drill string, to divert drilling fluid flowing upwardly in the annulus between the riser and drill string into the side port;

said actuator including three vertically spaced elastomeric sleeves within the housing recess, metal rings intermediate adjacent sleeves within the recess and above and below the uppermost and lowermost sleeves to contract the actuator sleeves inwardly to seal with the outside of the carrier body and thereby form upper, lower, and intermediate fluid pressure chambers within the recess outside of each sleeve, means for supplying control fluid from an outside source to each pressure chamber each of the intermediate metal rings having a port therethrough, and the carrier body and bearing rings having interconnected passageways connecting at opposite ends to the outer side of the carrier body;

means for supplying control fluid from an outside source to one end of each port in each metal ring, so that, when the actuator sleeves are contracted about the carrier body, it will circulate through the passageway and out the other end of each port in each metal ring in order to contract the sleeve of the insert packer onto the drill pipe;

the relief of control fluid permitting the sleeves of the actuator and the sleeve of the insert packer to expand to permit the insert packer to be retrieved.

9. As in claim 8, wherein;

the carrier body has a main portion in which one end of the recess is formed, and a retainer portion removably connected to the main portion and on which the other end of the recess is formed, whereby the sleeve and bearing rings may be installed or removed upon removal of the retainer portion.

10. As in claim 9, including:

a pin mounted on the housing for movement inwardly of the bore to support the carrier body; and another pin mounted on the housing and adapted to be moved inwardly to hold the carrier body in landed position.

* * * * *